United States Patent [19]

Schlough

[11] Patent Number: 4,708,277

[45] Date of Patent: Nov. 24, 1987

[54] STITCHING HEAD

[75] Inventor: James R. Schlough, Morrisonville, N.Y.

[73] Assignee: AM International Incorporated, Chicago, Ill.

[21] Appl. No.: 935,747

[22] Filed: Nov. 28, 1986

[51] Int. Cl.[4] ..... B27F 7/28; B27F 7/30

[52] U.S. Cl. ..... 227/88; 227/82; 227/156

[58] Field of Search ..... 227/81, 82, 84, 85, 227/86, 87, 88, 89, 90, 91, 156; 270/53

[56] References Cited

U.S. PATENT DOCUMENTS

| | | | |
|---|---|---|---|
| 2,574,380 | 11/1951 | Dutelle | 227/84 |
| 2,635,234 | 4/1953 | Reed | 227/84 |
| 4,196,835 | 4/1980 | Schlough | 227/81 |
| 4,236,706 | 12/1980 | Schlough | 270/53 |

FOREIGN PATENT DOCUMENTS

| | | | |
|---|---|---|---|
| 13164 | 7/1980 | European Pat. Off. | 227/84 |

*Primary Examiner*—Paul A. Bell

*Attorney, Agent, or Firm*—Tarolli, Sundheim & Covell

[57] ABSTRACT

A stitching head includes a crank rotatable about a longitudinal axis through an oscillatory displacement in each of the opposite drive and return directions of a cycle. The crank has a plurality of crank pins displaced radially from the longitudinal axis of the crank. A pivotally mounted staple supporter receives and supports an elongated piece of wire. A reciprocably mounted staple former cooperates with the staple supporter to form the piece of wire into a staple. A reciprocably mounted staple driver cooperates with the staple supporter and former to drive the staple into a product. A plurality of links couple the crank pins with the staple supporter, former and driver. The links cause independent but coordinated movement of the supporter, former and driver to form and drive the staple into the product. The crank pins are disposed at a plurality of separate locations on the crank radially displaced at different distances from the longitudinal axis of the crank.

32 Claims, 11 Drawing Figures

STITCHING HEAD

BACKGROUND OF THE INVENTION

1. Field of the Invention

The present invention relates to stitching, or stapling, collated signatures. Particularly, the present invention relates to a stitching head used for stapling collated signatures together.

2. Description of the Prior Art

Machines which form staples from wire and drive the staples into collated signatures are known. These known machines are typically used for binding books, pamphlets, magazines and the like.

Two signature collating machines which include a stitching head are disclosed in U.S. Pat. Nos. 4,196,835 and 4,236,706. The stitching heads are disposed above the path of a saddle conveyor which moves collated signatures. Each stitching head moves along a portion of the path in synchronization with the collated signatures. A clincher is disposed below the moving collated signatures. The stitching heads bend a short piece of wire to form a staple and drive the staple through the collated signatures as the signatures move. The clincher folds the ends of the staple to finish the stitching operation.

The stitching head of U.S. Pat. No. 4,196,835 includes a drive shaft which carries cams. Upon rotation of the drive shaft, the cams operate the stitching mechanism and clincher through linkage assemblies. The signature collating machines of the aforementioned patents perform satisfactorily and accomplish high speed binding. However, as with any system, there is a continuing need to make certain improvements.

SUMMARY OF THE INVENTION

The present invention is an improved stitching head. The stitching head of the present invention employs a single input motion to drive the stitching head through a stitching cycle. The input motion is an oscillation of a drive crank through 60 degrees of displacement. The drive crank has three crank pins located at different radii and phasing relative to the longitudinal axis of the drive crank. Four-bar linkages are used to transmit the motions of the three crank pins and to coordinate the operations carried out by the stitching head. The operations include supporting a piece of wire to form a staple, removing the staple supporter, and driving the staple into a product, such as collated signatures. This particular approach to transmitting the motions of the components enables a relatively lighter weight stitching head and one which can operate at a relatively higher speed.

The present invention is a stitching head which includes an input drive rotatable about an axis through a predetermined oscillatory displacement. A supporter receives and supports an elonged piece of wire. A former forms the piece of wire into a staple. A driver guides and drives the staple into a product. Links couple the drive crank with each of the supporter, former and driver to cause movement in a desired relationship. The stitching head further includes a knife for severing the piece of wire from a supply prior to forming the staple.

In a preferred embodiment, the supporter is movable between a supporting position and a retracted position. The supporter has a cradle portion which receives and supports the piece of wire. The former has spaced apart forming members disposed on opposite sides of the supporter. The forming members are movable between raised and lowered positions along and past the supporter. The forming members engage opposite end portions of the piece of wire to bend the end portions over the supporter. The driver is movable toward and away from the supporter. The links coordinate the respective movements of the supporter, former and driver. The supporter is pulled out of the path of the driver before the staple is driven into the product.

The links pivotally couple the supporter, former and driver with a plurality of crank pins on the drive crank which are radially displaced from the axis of the drive crank. The links cause independent and coordinated movement to form, guide and drive the staple into the product. The links include four-bar linkages separately coupling the supporter, former and driver with the drive crank.

BRIEF DESCRIPTION OF THE DRAWINGS

Further features of the present invention will become apparent to those skilled in the art to which the present invention relates from a reading of the following specification made with reference to the accompanying drawings, in which.

DETAILED DESCRIPTION OF THE INVENTION

Figure 1:
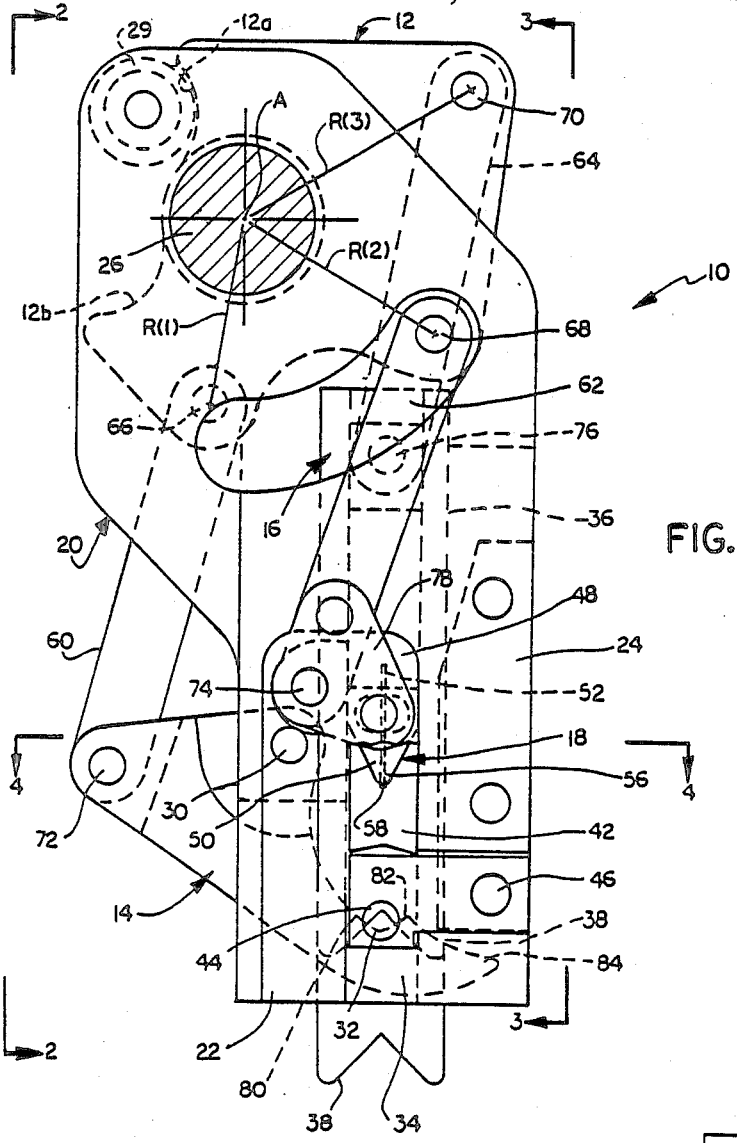
FIG. 1 is a side elevational view of the stitching head embodying the present invention.

Referring to FIGS. 1 to 4, a single input, multiple output stitching head 10 embodying the present invention is illustrated. The stitching head 10 can be incorporated as part of a stitching assembly in a signature collating apparatus similar to the ones of the aforementioned U.S. Pat. Nos. 4,196,835 and 4,236,706 to Schlough, which are incorporated herein by reference.

The stitching head 10 includes a crank 12, a staple supporter 14, a staple former 16 and a staple driver 18. A frame 20 includes frame sides 24 spaced apart by blocks 22. A shaft 26 is supported for rotation about axis A by the frame sides 24 in bearings 28. The crank 12 is fixed to the shaft 26. The shaft 26 and the crank 12 are rotatably moved by a suitable drive source (not shown) connected to the shaft. The crank 12 moves through an oscillatory displacement, such as sixty degrees, in opposite drive and return directions of a complete cycle. The crank 12 includes surfaces **12*a* and 12*b* which engage a stop 29, supported by the frame 20**, to prevent crank oscillation beyond a desired amount.

Figure 9:
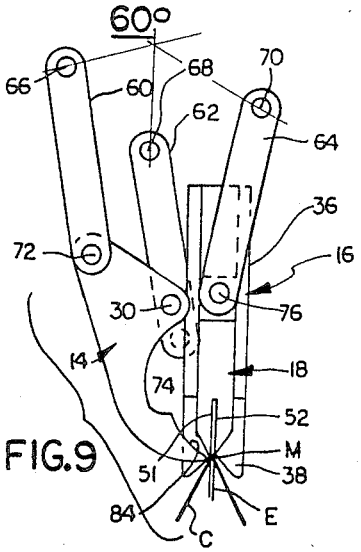
Figure 10:
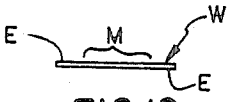
FIGS. 10 and 11 are elevational views illustrating a wire piece before and after being formed into a staple.
Figure 11:
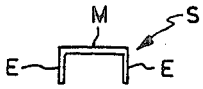

The staple supporter 14 of the stitching head 10 is pivotally mounted between the spaced frame sides 24 by a pin 30. The supporter 14 has a cradle portion 32 shaped as an upwardly open shallow vee defined on an end portion 34. The cradle portion 32 is adapted for receiving and supporting an elongated piece of wire W (FIG. 10). The width of the cradle portion 32 is less than the length of the piece of wire W. The cradle portion 32 supports the wire W along a middle portion M (FIGS. 10 and 11). Opposite end portions E extending beyond the opposite sides of the cradle portion 32. The staple supporter 14 pivots relative to the frame 20 between a supporting position (FIGS. 1 and 5–7) and a retracted, nonsupporting position (FIG. 9).

Figure 4:
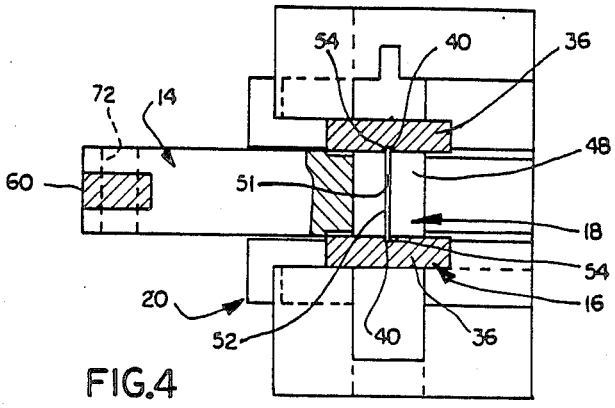
FIG. 4 is a cross-sectional view of the stitching head taken approximately along the line 4—4 of FIG. 1.
Figure 2:
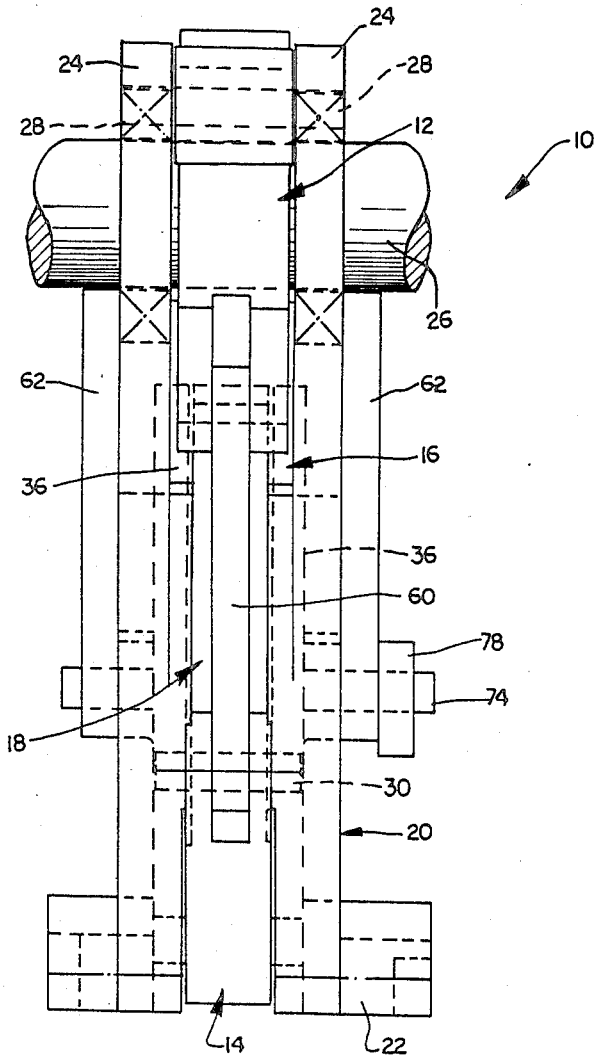
FIG. 2 is a rear elevational view of the stitching head, as seen along line 2—2 of FIG. 1.
Figure 3:
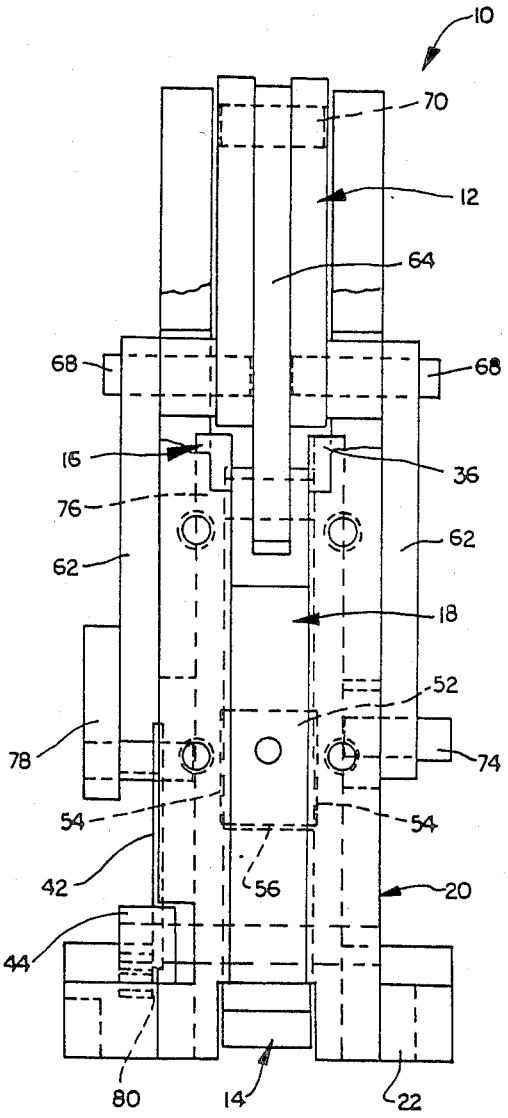
FIG. 3 is a front elevational view of the stitching head as seen along line 3—3 of FIG. 1.

The staple former 16 (FIG. 1) of the stitching head 10 includes a pair of spaced apart elongated forming members 36 (FIG. 4). The forming members 36 are reciprocably mounted along the interior of one of the frame sides 24 and spaced apart to receive the outer end 34 of the staple supporter 14 therebetween. The forming members 36 are reciprocably movable relative to the frame 20 and relative to the staple supporter 14 between raised and lowered positions along and past the opposite sides of the end portion 34 of the staple supporter.

The staple former 16, in cooperation with the staple supporter 14, forms the piece of wire W into a staple S (FIG. 11). The forming members 36 have lower ends 38 with inverted downwardly open shallow vee configurations aligned above and laterally outward of the vee shaped cradle portion 32 of the staple supporter 14. The forming members 36 have respective opposing longitudinally extending grooves 40 (FIGS. 4 to 8) at their interior opposite facing sides. The grooves 40 are vertically alinged with the apices of the vee configurations of the lower ends 38 of the forming members 36 and the cradle portion 32 of the staple supporter 14.

As the forming members 36 move from the raised toward the lowered position, the lower ends 38 engage opposite end portions E of the piece of wire W to bend the end portions E of the wire approximately ninety degrees relative to the middle portion M. The staple S is formed with the middle portion M disposed in the cradle portion 32 of the staple supporter 14. The bent end portions E are disposed between the staple supporter 14 and the forming members 36 within the longitudinal grooves 40.

The stitching head 10 further includes a knife blade 42 (FIG. 3) mounted along the exterior of one of the frame sides 24. The blade 42 is coupled to one of the forming members 36 for reciprocable movement in a vertical direction to sever the piece of wire W from a continuous supply of wire (not shown). The blade 42 moves to sever the wire W prior to the start of forming the wire W into a staple S. The blade 42 is moved past a hardened hollow sleeve 44 through which the wire W is fed from the continuous supply. The sleeve 44 is adjustably connected by fastener 46 to one of the frame sides 24 adjacent the mounting base 22 of the frame 20 to align with the cradle portion 32. The sleeve 44 is adjustable to set the length of wire W being fed and to determine the position of the severed piece of wire W in the head 10.

The staple driver 18 (FIG. 4) of the stitching head 10 is reciprocably mounted between the forming members 36 for vertical movement. The staple driver 18 includes a main body 48 having a tapered lower end 50 defining a transverse vertical slot 51 and a flat plate 52 mounted in the slot in alignment above the piece of wire W. Opposite lateral edges 54 of the plate 52 extend laterally outward of the sides of the main body 48 and slidably fit within the grooves 40 in the forming members 36. A bottom edge 56 of the plate 52 is displaced a small distance above the lower end 50 of the main body 48 so as to define a linearly-extending recess 58 for receiving the middle portion M of the staple S. The staple driver 18 is reciprocably movable between the spaced forming members 36 of the staple former 16. When the staple driver 18 moves downwardly, the bottom edge 56 of the plate 52 engages the middle portion M of the staple S disposed in the cradle portion 32. The bent end portions E of the staple S remain within the grooves 40 of the forming members 36. The staple driver 18 drives the staple toward and into a series of collated signatures C disposed directly below the head 10 (FIGS. 5 to 9). Thus, the staple driver 18 cooperates with the staple supporter 14 and staple former 16 in guiding and driving the staple into a product.

The stitching head 10 includes a plurality of links 60, 62 and 64 for transmitting the motion of the crank 12 to the respective staple supporter 14, former 16 and driver 18. The crank 12 has a plurality of crank pins 66, 68 and 70 journalled at separate locations radially displaced at different distances from the rotational axis A. A first link 60 pivotally interconnects a first crank pin 66 on the crank 12 and a pivot pin 72 on an opposite end of the staple supporter 14. A pair of links 62 pivotally interconnect respective axially aligned second pivot pins 68 on the drive crank 12 and pivot pins 74 journalled on the forming members 36. A third link 64 pivotally interconnects a third crank pin 70 on the drive crank 12 and a pivot pin 76 on the upper end of the main body 48 of the staple driver 18.

The links 60, 62, 64 couple the crank pins 66, 68, 70 with the staple supporter 14, former 16 and driver 18 for independent but coordinated movement to form, guide and drive the staple S into the product. The links 60, 62, 64 define a four-bar linkages separately coupling the staple supporter 14, former 16 and driver 18 with the input drive crank 12. Another link 78 connects the knife blade 42 to one of the second links 62 so that the blade 42 moves with the one forming member 36 to sever the wire W. The lower severing edge 80 of the blade 42 engages the wire W before the lower end 38 of the respective forming member 36 engage the wire.

Referring now to FIGS. 5 through 9, the stitching head 10 is shown at successive fifteen degree increments of the sixty degree drive half of an oscillatory cycle of the crank 12. The staple supporter 14, former 16 and driver 18 move concurrently as the crank 12 rotates. The staple supporter 14 and former 16 complete respective movements first. This is due to the relative lengths of the respective radii and phasing of the crank pins 66, 68, 70 relative to the rotational axis A of the drive crank 12. The radius R (1) between the rotational axis A of the drive crank 12 and the first crank pin 66 journalled to the first link 60 is shortest. The radius R (3) between the axis A and the third crank pin 70 journalled to the third link 64 is longest. The radius R (2) is between radii R (1) and R (3) in length. Thus, in sixty degrees of rotation of the crank 12, the length of the arc traversed by the first crank pin 66 is shortest. The third crank pin 70 traverses the longest arc. The second crank pins 68 traverse an arc between those of the first and third crank pins 66, 70, respectively.

Figure 5:
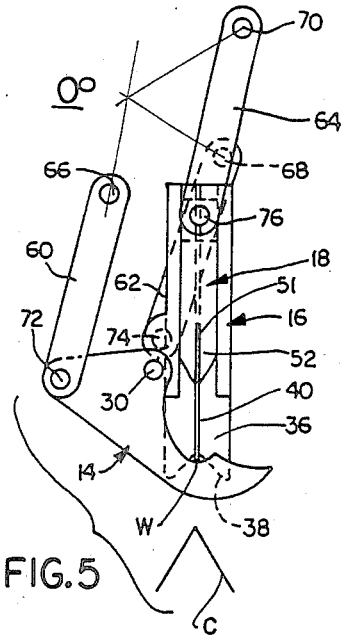
FIGS. 5–9 are side elevational views of the stitching head having selected parts in different relative positions.

In FIG. 5, beginning at the zero degree position of the crank 12 along the drive cycle, the staple supporter 14 is in a supporting position. The cradle portion 32 of the staple supporter 14 supports the wire W. The staple former 16 is at the raised position. The staple driver 18 is in the raised position above the wire W and the cradle portion 32 of the staple supporter 14. A series of collated signature C are disposed below the stitching head 10. The collated signatures move along a path with the stitching head 10 in a direction parallel to the wire W.

Figure 6:
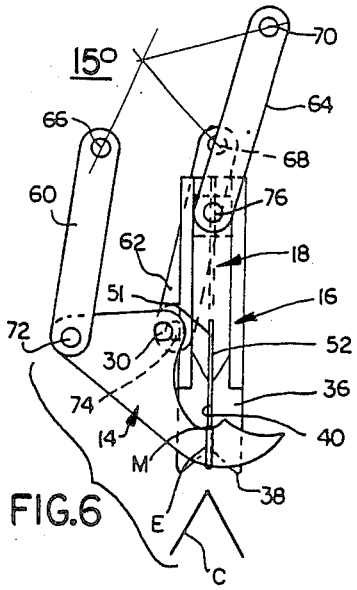

In FIG. 6, at fifteen degrees of rotation of the crank 12, links 62 force the two forming members 36 of the staple former 16 to descend along the opposite sides of the outer end 34 of the staple supporter 14. The blade 42 severs the wire W from the supply. The first link 60 passes through a dead-center condition, where the link 60 is parallel to the radius R (1), to force the staple supporter 14 to pivot about pin 30 a small amount. The forming members 36 bend the end portions E of the wire W ninety degrees downwardly relative to the middle portion M supported on the cradle portion 32. The link 64 starts to move the staple driver 18 downwardly toward the cradle portion 32 of the staple supporter 14.

Figure 7:
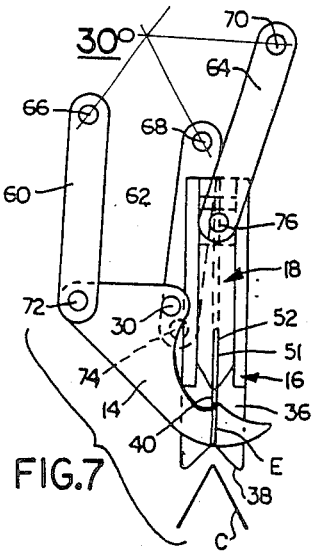

FIG. 7 illustrates the crank 12 at thirty degrees of rotation. The two forming members 36 are still forced downwardly by links 62. The staple supporter 14 pivots clockwise as the link 60 passes dead-center and begins upward movement. The middle portion M of the staple S remains stationary as the inclined surface 82 of the cradle portion 32 slides past the staple on a constant arc about the pivot pin 30. The bent opposite end portions E remain within the grooves 40 between the forming members 36. Link 64 forces the staple driver 18 to continue to descend toward the staple S.

Figure 8:
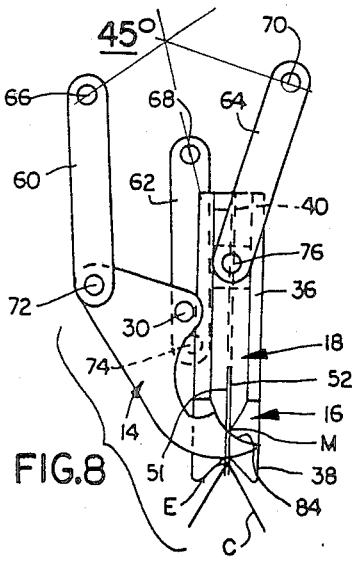

In FIG. 8, at the forty-five degrees of rotation of the crank 12, the links 62 pass through the dead-center condition and the two forming members 36 remain substantially stationary in an overlying relation to the collated signatures C. The forming members 36 compress the fold of the signatures C to facilitate penetration by the tips of the staple S. The middle portion M of the staple S is supported on the right inclined end surface 84 of the staple supporter 14. The link 60 forces the staple supporter 14 to move toward the retracted position at an accelerating rate. Link 64 forces the staple driver 18 to drive the tips of the bent end portions E of the staple S through the signatures C. The remainder of the bent end portions E of the staple S are still guided within the grooves 40 and against the sides of the end surface 84 to prevent buckling as the signatures C are penetrated by the tips.

In FIG. 9, at sixty degrees of rotation of the crank 12, the link 60 pulls the staple supporter 14 to fully retract out of the path of the driver 18. Link 64 forces the staple driver 18 to completely drive the end portions E of the staple S through the signatures C. The drive source then reverses the crank 12 through a sixty-degree return displacement to complete one oscillatory cycle. The components of the stitching head 10 are returned to the initial positions as illustrated in FIG. 5. A dwell in the movement occurs at the zero degree position of FIG. 5 to allow time for the wire W to be fed into the cradle portion 32 of the staple supporter 14 for the next stitching cycle.

In summary, the links 60, 62, 64 coordinate the respective movements of the staple supporter 14, former 16 and driver 18 to form a staple S and pull the staple supporter 14 out of the path of movement of the staple driver 18. As the staple supporter 14 is pulled out of the path of movement of the staple driver 18, it continues to cooperate with the staple former 16 to guide the staple S.

From the above description of a preferred embodiment of my invention, those skilled in the art will perceive improvements, changes and modifications. Such improvements, changes and modifications within the skill of the art are intended to be included herein and covered by the appended claims.

Having described a preferred embodiment, I claim:

1. A stitching head comprising:

a crank rotatable about an axis through a predetermined oscillatory displacement;

first movable means for receiving and supporting an elongated piece of wire;

second movable means cooperable with said first movable means for forming the piece of wire into a staple;

third movable means cooperable with said first and second movable means for guiding and driving the staple into a product; and motion transmitting means separately coupling said crank with said first, second and third movable means for causing independent and coordinated movement thereof in response to crank rotation to form the piece of wire into the staple and drive the staple into the product.

2. The stitching head as recited in claim 1, further comprising fourth movable means being coupled to said second movable means for severing the piece of wire from a supply of wire prior to forming of the piece of wire into the staple.

3. The stitching head as recited in claim 1, wherein said first movable means is a staple supporter being movable between a support position and a retracted position.

4. The stitching head as recited in claim 3, wherein said second movable means is a staple former having spaced apart forming members which receive said staple supporter therebetween and are movable between raised and lowered positions along and past opposite sides of said staple supporter.

5. The stitching head as recited in claim 4, wherein said spaced forming members of said staple former have respective opposing grooves defined therein for guiding the staple toward the product as said third movable means drives the staple toward the product.

6. The stitching head as recited in claim 4, wherein said third movable means is a staple driver movable toward and away from said staple supporter and between said spaced forming members of said staple former.

7. The stitching head as recited in claim 6, wherein said motion-transmitting means coordinates the respective movements of said staple supporter, former and driver to pull said staple supporter out of the path of movement of said staple driver as the staple driver moves toward said staple supporter.

8. The stitching head as recited in claim 7, wherein said staple supporter cooperates with said staple former in guiding the staple toward the product as said staple driver drives the staple toward the product.

9. The stitching head as recited in claim 3, wherein said staple supporter has a cradle portion which receives and supports the piece of wire along a middle portion thereof.

10. The stitching head as recited in claim 9, wherein said second movable means is a staple former having spaced apart forming members which receive said staple supporter therebetween and are movable between raised and lowered positions along and past opposite sides of said staple supporter.

11. The stitching head as recited in claim 10, wherein said forming members of said staple former are engageable with opposite end portions of the piece of wire to bend the end portions of the wire relative to the middle portion thereof, as said forming members move from the raised to the lowered positions to form the staple with the middle portion being disposed in said cradle portion of said staple supporter and bent end portions being disposed between said staple supporter and said forming members of said staple former.

12. The stitching head as recited in claim 11, wherein said spaced forming members of said staple former have respective opposing grooves defined therein which receive the bent end portions of the staple being disposd between said staple supporter and said forming members of said staple former.

13. The stitching head as recited in claim 12, wherein said third movable means is a staple driver movable toward and away from said cradle portion of said staple supporter and between said spaced forming members of said staple former to engage the middle portion of the staple disposed in said cradle portion of said staple supporter.

14. The stitching head as recited in claim 13, wherein said motion transmitting means coordinates the respective movements of said staple supporter, former and driver to pull said staple supporter out of the path of movement of said staple driver as the staple driver moves toward said staple supporter.

15. The stitching head as recited in claim 14, wherein said staple supporter cooperates with said staple former to confine the bent end portions of the staple within said grooves to guide the staple toward the product as said staple driver moves along the path of movement.

16. The stitching head as recited in claim 14, wherein said motion transmitting means includes a plurality of links pivotally coupling a plurality of separate locations on said crank being radially displaced from said rotational axis thereof with respective ones of said staple supporter, former and driver for causing independent and coordinated movement thereof to form the piece of wire into the staple and drive the staple into the product.

17. The stitching head as recited in claim 16, wherein a pair of said links pivotally couples one of said locations on said crank with said respective forming members of said staple former.

18. The stitching head as recited in claim 16, wherein said plurality of links define a four-bar linkage separately coupling said staple supporter, former and driver with said crank.

19. The stitching head as recited in claim 1, wherein said crank is rotatable in a drive half of one cycle through an oscillatory displacement of sixty degrees.

20. A stitching head comprising:

a crank rotatable about an axis through a predetermined oscillatory displacement and having a plurality of crank pins displaced radially from said axis;

a pivotally mounted staple supporter for receiving and supporting an elongated piece of wire;

a reciprocably mounted staple former cooperable with said staple supporter for forming the piece of wire into a staple;

a reciprocably mounted staple driver cooperable with said staple supporter and former for guiding and driving the staple into a product; and a plurality of motion transmitting links coupling separate ones of said plurality of crank pins with respective separate ones of said staple supporter, former and driver for causing independent and coordinated movement thereof in response to crank rotation to form the piece of wire into the staple and drive the staple into the product.

21. The stitching head as recited in claim 20, wherein said crank pins are defined at a plurality of separate locations on said crank being radially displaced from said rotational axis thereof at different distances.

22. The stitching head as recited in claim 20, wherein said staple former includes a pair of spaced forming members and a pair of said links pivotally couples one of said locations on said crank with said respective forming members.

23. The stitching head as recited in claim 20, wherein said plurality of links define a four-bar linkage separately coupling said staple supporter, former and driver with said crank.

24. The stitching head as recited in claim 20, wherein said crank is rotatable in a drive half of one cycle through an oscillatory displacement of sixty degrees.

25. The stitching head as recited in claim 20, wherein said staple supporter has a cradle portion which receives and supports the piece of wire along a middle portion thereof.

26. The stitching head as recited in claim 25, wherein said staple former has spaced apart forming members which receive said staple supporter threrebetween and are movable between raised and lowered positions along and past opposite sides of said staple supporter.

27. The stitching head as recited in claim 26, wherein said forming members of said staple former are engageable with opposite end portions of the piece of wire to bend the end portions of the wire with respect to the middle portion thereof, as said forming members move from the raised to the lowered positions, to form the staple with the middle portion being disposed in said cradle portion of said staple supporter and bent end portions being disposed between said staple supporter and said forming members of said staple former.

28. The stitching head as recited in claim 27, wherein said spaced forming members of said staple former have respective opposing grooves defined therein which receive the bent end portions of the staple being disposed between said staple supporter and said forming members of said staple former.

29. The stitching head as recited in claim 28, wherein said staple driver is movable toward and away from said cradle portion of said staple supporter and between said spaced forming members of said staple former into engagement with the middle portion of staple disposed in said cradle portion of said staple supporter.

30. The stitching head as recited in claim 29, wherein said motion transmitting links coordinate the respective movements of said staple supporter, former and driver to pull said staple supporter out of the path of movement of said staple driver.

31. The stitching head as recited in claim 30, wherein said staple supporter cooperates with said staple former to confine the bent end portions of the staple within said grooves therein and thereby guide the staple toward the product concurrently as said staple driver moves along its path of movement.

32. The stitching head as recited in claim 20, further comprising a reciprocably mounted knife coupled to said staple former for movement therewith to sever the piece of wire from a supply of wire prior to forming the wire piece into the staple.

* * * * *